United States Patent [19]

Tao et al.

[11] Patent Number: 4,580,971

[45] Date of Patent: Apr. 8, 1986

[54] OIL HEATER

[75] Inventors: Muneo Tao, Yamatokoriyama; Hiromi Ohta, Ikoma; Masayuki Fujimoto, Yamatokoriyama, all of Japan

[73] Assignee: Matsushita Electric Industrial Co., Ltd., Kadoma, Japan

[21] Appl. No.: 726,375

[22] Filed: Apr. 23, 1985

[30] Foreign Application Priority Data

Apr. 26, 1984 [JP] Japan ..... 59-85423

[51] Int. Cl.[4] ..... F23D 3/32

[52] U.S. Cl. ..... 431/307; 126/96; 431/201; 431/304

[58] Field of Search ..... 431/195-201, 431/304, 305, 306, 307; 126/45, 96, 92 R, 92 AC, 93

[56] References Cited

U.S. PATENT DOCUMENTS

| | | | |
|---|---|---|---|
| 2,503,153 | 4/1950 | Engh et al. | 431/307 |
| 3,279,524 | 10/1966 | Nozaki et al. | 126/96 |
| 4,417,870 | 11/1983 | Nakamura et al. | 431/307 |
| 4,424,019 | 1/1984 | Nakamura et al. | 431/307 |
| 4,458,664 | 7/1984 | Uchida | 126/96 |
| 4,498,862 | 2/1985 | Nakamura et al. | 431/307 |

FOREIGN PATENT DOCUMENTS

| | | | |
|---|---|---|---|
| 49713 | 3/1982 | Japan | 431/304 |
| 139210 | 8/1982 | Japan | 431/307 |
| 1461735 | 1/1977 | United Kingdom | 431/307 |

*Primary Examiner*—James C. Yeung

*Attorney, Agent, or Firm*—Wenderoth, Lind & Ponack

[57] ABSTRACT

An oil heater having a wick fed radiant burner which comprises a wick adjusting shaft rotatable in first and second directions about the longitudinal axis thereof; a wick holder for moving together therewith a wick between an extinguishing position and a maximum combustion position past a minimum combustion position in response to the rotation of the shaft; a ratchet wheel mounted on the shaft for displacement axially of the shaft; an actuating pin mounted on the shaft and angularly movable together with the shaft; an abutment bank provided on the wheel for defining the angular distance over which the pin moves, which angular distance corresponds to the distance of movement of the wick holder between the maximum combustion position and the extinguishing position; and a one-way stopper provided on the wheel and operable to permit the pin to pass thereover during the rotation of the shaft in the second direction, but to restrain the pin from passing thereover during the rotation of the shaft in the first direction thereby defining the minimum combustion position. The pin once restrained can be released from the stopper when the shaft is rotated in the first direction by the application of an external rotary force sufficient to cause the pin to displace the wheel against the biasing spring while permitting the pin to pass over the stopper.

9 Claims, 10 Drawing Figures

OIL HEATER

BACKGROUND OF THE INVENTION

The present invention generally relates to an oil heater of a type having a wick fed radiant burner and, more particularly, to a wick raising and lowering mechanism in the oil heater.

In general, an oil heater having a wick fed radiant burner, the output of which is controllable by raising and lowering the wick, has a problem in that, when the wick once raised towards a maximum combustion position at which the highest burner output is available is excessively lowered in an attempt to adjust the burner output to a minimum value, incomplete combustion of fuel such as, for example, kerosene, is liable to occur accompanied by the emission of a considerable amount of carbon monoxide and other obnoxious exhaust gases.

In order to obviate this problem, a wick raising and lowering mechanism utilizing a one-way stopper operable only during the wick lowering operation and defining a minimum combustion position for the wick at which the lowest possible burner output is available, has been devised and disclosed in, for example, Japanese Laid-open Utility Model Publication No. 56-173808, published in 1981 and corresponding to U.S. Pat. No. 4,424,019 patented Jan. 3, 1984. For the purpose of the discussion of the prior art believed to be closest to the present invention, some of the drawings employed in the above mentioned prior art reference are herein reproduced and numbered FIGS. 6 and 7, reference to which will now be made.

Referring first to FIG. 6 which is a partial transverse sectional view of the prior art oil heater as viewed from top, the wick raising and lowering mechanism, hereinafter referred to as "wick adjustment", comprises a rotary shaft 25 supported for rotation about its own longitudinal axis and also for axial movement between engageable and released positions in a direction perpendicular to a cylindrical wick 21 which is adapted to pass, i.e., helically raised and lowered one at a time, through the annular space between outer and inner wick tubes 22*a* and 22*b*, the outer wick tube 22*a* being supported for helical rotation relative to the inner wick tube 22*b* and having a plurality of spikes engageable with the wick 21. The wick adjustment also comprises a rack plate 23 curved so as to follow the curvature of the outer wick tube 22*a* and extending an angular distance about the longitudinal sense of the outer wick tube 22*a* with its opposite ends exteriorly secured to the outer wick tube 22*a*. As best shown in FIG. 7, the rack plate 23 has a rack slot defined therein so as to extend obliquely relative to the longitudinal sense of the outer wick tube 22*a* and having a linear rack defined at 24 for engagement with a pinion gear 26 which is rigidly mounted on the rotary shaft 25 for movement together with the rotary shaft 25. This pinion gear 26 is constantly drivingly engaged with the rack 24 regardless of the position of the rotary shaft in a direction axially thereof, and the rotary shaft 25 is normally urged by a biasing spring 27 to the engageable position as shown in FIG. 6 with its inner end face 25*a* held in sliding contact with or in proximity of the outer wick tube 22*a*.

In the construction so far described, the rotation of the shaft 25 and, hence, the pinion 26 in one of the oppsite directions, for example, clockwise as viewed in FIG. 7 results in the raise of the wick 21 from an extinguishing position, at which the top of the wick 21 is completely accommodated within the annular space between the outer and inner wick tubes 22*a* and 22*b*, towards the maximum combustion position, together with the outer wick tube 22*a*. The rotation of the shaft 25 and, hence, the pinion 26 in the other of the opposite directions, i.e., counterclockwise, results in the movement of the wick 21 in a direction reverse to that described above. When and so long as the wick 21 is held at the extinguishing position, one of the rack teeth located at an upper end of the rack 24, that is, the rack tooth identified by 24*a*, is engaged with the pinion 26 whereas when and so long as the wick 21 is held at the maximum combustion position, the rack tooth 24*b* located at the other, lower end of the rack 24 is engaged with the pinion 26.

In order to avoid the excessive lowering of the wick 21 towards the extinguishing position past a minimum combustion position at which the burner can give a minimum output with no substantial occurrence of incomplete combustion, that is, without being substantially accompanied by the considerable emission of CO and HC components, the outer wick tube 22*a* is provided with a sloped projection or lug 28 formed by, for example, lancing a portion of the outer wick tube 22*a*, which corresponds in position to the minimum combustion position, so as to protrude outwardly of the outer wick tube 22*a* and into the path of movement of the inner end of the rotary shaft 25 relative to the outer wick tube 22*a*. This sloped lug 28 is so shaped and so oriented that, during the counterclockwise rotation of the outer wick tube 22*a*, as viewed in FIG. 6, caused by the clockwise rotation of the rotary shaft 25, the inner end face 25*a* of the shaft 25 can slide over the sloped lug 28 while the shaft 25 is permitted to axially displace against the biasing spring 27, but during the clockwise rotation of the outer wick tube 22*a* caused by the counterclockwise rotation of the shaft 25, the inner end of the shaft 25 can be brought into abutment with the sloped lug 28, thereby disabling the continued clockwise rotation of the outer wick tube 22*a*.

Thus, in the prior art oil heater, while the wick 21 held in the extinguishing position can be moved or raised to the maximum combustion position merely be continuously rotating the rotary shaft 25 in the clockwise direction through a predetermined angle over which the shaft 25 can rotate about its longitudinal axis, the counterclockwise rotation of the shaft 25 starting from the condition in which the wick 21 is held at the maximum combustion position is temporarily interrupted when the inner end of the shaft 25 is brought into abutment with the sloped lug 28 at which time the wick is brought to the minimum combustion position. Therefore, no possibility occurs that the wick is excessively lowered during an attempt to adjust the burner output to a minimum value without incomplete combustion of fuel brought about. However, this merit appears to have created a disadvantage of the prior art oil heater by the following reason.

In order to further lower the wick 21 in the minimum combustion position towards the extinguishing position to extinguish the burner flame, the rotary shaft 25 must be, while an external force necessary to turn it counterclockwise is continuously applied thereto, pulled against the spring 27 to let the inner end of the shaft 25 disengage from the sloped lug 28 and then start sliding relatively down along the slope of the sloped lug 28. This procedure is awkward and inconvenient to follow, and this is particularly true where the wick 21 then held at the maximum combustion position is desired to be lowered to the extinguishing position all the way at a stroke.

SUMMARY OF THE INVENTION

Accordingly, the present invention has been developed with a view to substantially eliminating the above described disadvantages and inconveniences inherent in the prior art oil heater of the type having the wick fed radiant burner and has for its essential object to provide an improved oil heater wherein not only is means provided for permitting the wick to be adjusted between the maximum and minimum combustion positions when the wick fed burner is in operation, but also the extinction of the burner flame can readily and easily be achieved.

In order to accomplish this object of the present invention, there is provided an improved oil heater having a wick fed radiant burner which comprises a shaft means rotatable in first and second directions one at a time for rising and lowering a wick between a combustion position and an extinguished position, a spring means capable of accumulating a biasing force necessary to lower the wick, held at the combustion position, to the extinguished position pursuant to the manipulation of the shaft means, a rotatable body rotatably mounted on the shaft means and having its periphery provided with a plurality of teeth, a locking element engageable with any one of the teeth of the rotatable body under pressure for preventing the rotatable body from rotating in the same direction as the second direction of rotation of the shaft means, an actuating member provided on the shaft means and pressed by the rotatable body, and a one-way stopper provided on that portion of the rotatable body which is located on the path of angular movement of the actuating member and operable to interrupt the rotation of the shaft means in the second direction at a predetermined position, said rotatable body being so supported by said biasing spring that, by the application of an external rotating force greater than that required to rotate the shaft means in the second direction, the rotatable body can be displaced axially of the shaft means to permit the rotation of the rotatable body.

BRIEF DESCRIPTION OF THE DRAWINGS

This and other objects and features of the present invention will become clear from the following description taken in conjunction with the preferred embodiments thereof with reference to the accompanying drawings, in which.

DETAILED DESCRIPTION OF THE EMBODIMENTS

Figure 1:
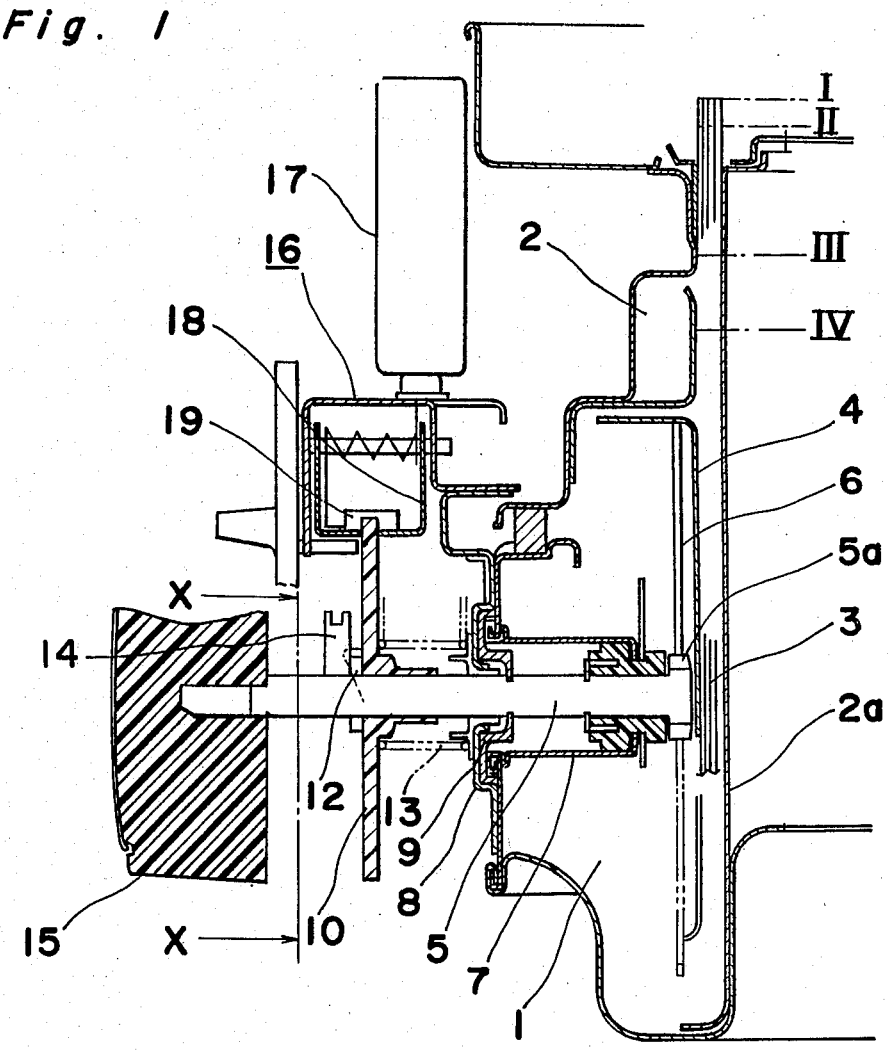
FIG. 1 is a longitudinal sectional view of a portion of an oil heater showing the details of a wick adjustment incorporated therein.

Referring to FIG. 1, there is fragmentarily shown an oil heater having a wick fed radiant burner 2 which comprises an oil tank 1, an inner wich tube 2*a* and an outer wick tube 4 coaxial with the inner wick tube 2*a* and movable positioned exteriorly of the inner wick tube 2*a* so as to define a cylindrical annular space in which a cylindrical wick 3 is displaceably accommodated. The cylindrical annular space is communicated at a lower end thereof with the interior of the oil tank 1 and at an upper end with the outside, said upper end defining an annular burner opening through which a top end of the cylindrical wick 3 can protrude outwards and retract inwards selectively. The outer wick tube 4 is supported for movement in a direction circumferentially of the inner wick tube 2*a* and also in a direction parallel to the longitudinal axis of the inner wick tube 2*a* and has its inner surface formed with a plurality of spikes engaged with and enabling the wick 3 to be moved together with the outer wick tube 4.

Figure 7:
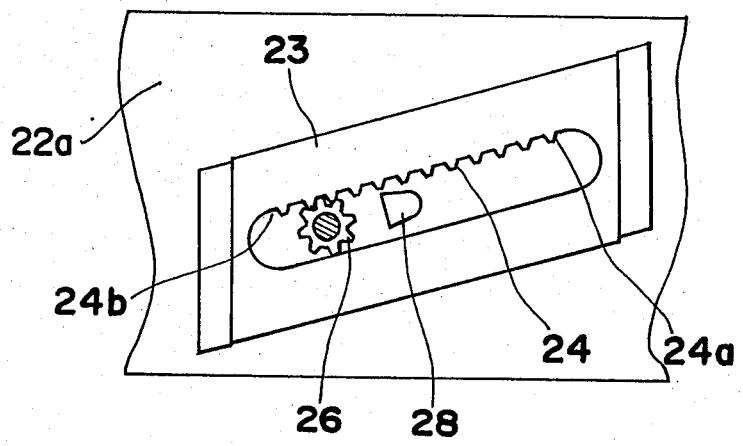
Fig. 7 Prior Art
FIG. 7 is a front elevational view, on an enlarged scale, of the rack plate used in the prior art oil heater shown in FIG. 6.

Exteriorly of the outer wick tube 4, a rack plate 6 of a construction substantially identical with the rack plate shown in FIG. 7 and having a diagonally extending linear rack is secured rigidly to the outer wick tube 4. Operatively engaged with the linear rack in the rack plate 6 and situated within the diagonally extending slot in the rack plate 6 is a pinion gear 5*a* mounted on a wick adjusting shaft 5. This wick adjusting shaft 5 is rotatably supported by an oil tank casing by means of a bearing sleeve 7 secured to the tank casing so as to extend inwardly of the tank 1. Reference numeral 8 represents a bearing fixture secured to the tank casing and carrying a sealing ring 9 through which the shaft 6 extends rotatably. The other end of the shaft 5 remote from the pinion gear 5*a* has a knob 15 rigidly mounted thereon for rotation together with the shaft 5, said knob 15 being accessible to the hand of an operator or user of the oil heater.

Figure 2:
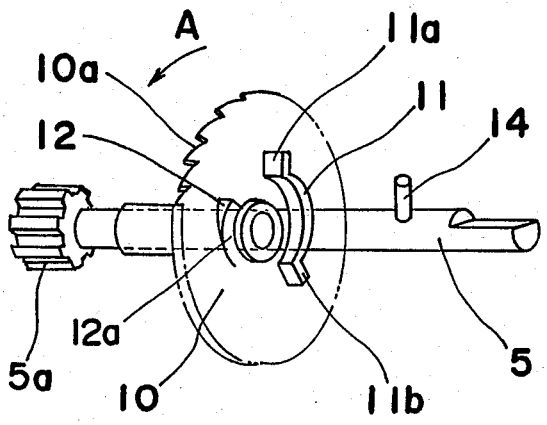
FIG. 2 is a perspective view of a wick adjusting shaft employed in the wick adjustment.
Figure 3A:
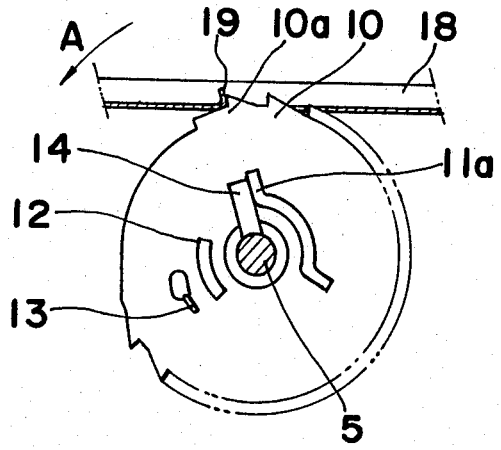
FIG. 3 is a cross-sectional view taken along the line X—X in FIG. 1, which is composed of FIGS. 3(*a*), 3(*b*), 3(*c*) and 3(*d*) showing respective different angular positions of an actuating pin on the wick adjusting shaft relative to a rotary disc.
Figure 3B:
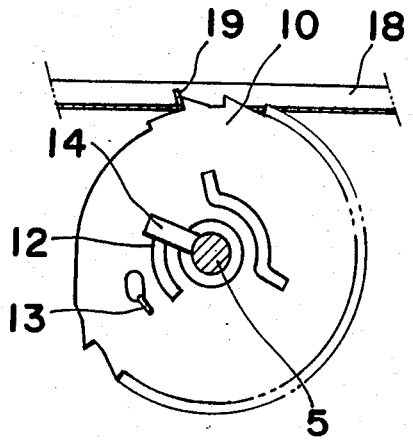
Figure 3C:
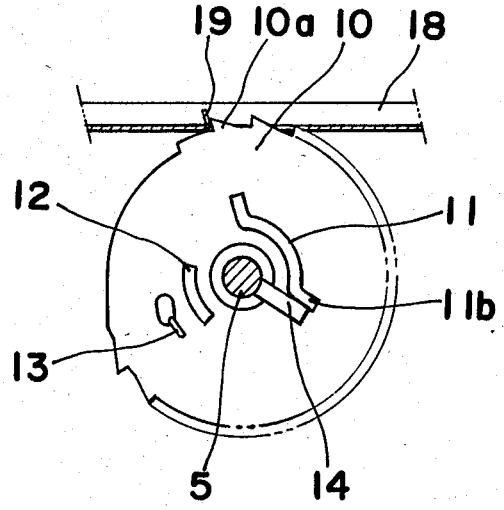
Figure 3D:
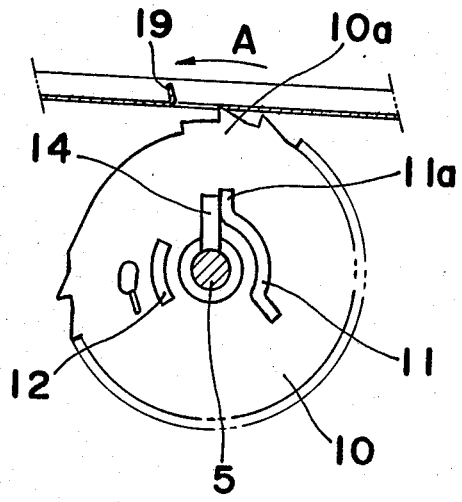

A rotary disc 10 having its periphery formed with ratchet gear 10*a* and preferably made of polyacetal resin is mounted on the shaft 5 for rotation about and independently of the shaft 5 and also for displacement axially of the shaft 5 and positioned between the bearing fixture 8 and an actuating pin 14, said actuating pin 14 being rigidly secured to the shaft 5 so as to extend transversely of the shaft 5. As best shown in FIG. 2, one face of the rotary disc 10 facing the actuating pin 14 is integrally formed with a generally arcuate bank 11 curved so as to extend around the shaft 5 through a predetermined angle and having its opposite ends 11*a* and 11*b* so shaped, or so bent, as to orient radially outwardly relative to the shaft 5, each of said ends 11*a* and 11*b* being engageable with the actuating pin 14 as will be described later. This one face of the rotary disc 10 is also integrally formed with a one-way stopper 12 positioned on one side of the shaft 5 generally opposite to the arcuate bank 11.

The rotary disc 10 of the above described construction is normally urged in a direction axially of the shaft 5 by a circumferentially and axially prestressed coil spring 13 loosely mounted around the shaft and interposed between the rotary disc 10 and the bearing fixture 8 with its opposite ends rigidly secured respectively to the rotary disc 10 and the bearing fixture 8. This coil spring 13 is so prestressed as to exert not only an axially biasing force for urging the rotary disc 10 to permit the face of the rotary disc 10 to be pressed against the actuating pin 14, but also a circumferentially biasing force for urging the rotary disc 10 in a direction counterclockwise about the shaft 5, as viewed in FIG. 3, to permit the bent end 11*a* of the arcuate bank 11 to push the actuating pin 14 when the rotary disc 10 is allowed to rotate freely as will be described later.

The coil spring 13 is held in a circumferentially prestressed condition by a pawl member 19 engaged with one of the ratchet teeth 10*a* of the rotary disc 10 so as to lock the rotary disc 10 at an operative position as shown in FIGS. 3(*a*) to 3(*c*). With the rotary disc 10 located at the operative position as hereinbefore described and as shown in FIGS. 3(*a*) to 3(*c*), the operator or user of the oil heater embodying the present invention can turn the knob 15 and, hence, the wick adjusting shaft 5 in any one of the opposite, raising and lowering directions through a predetermined angle delimited by the angular distance between the bent ends 11*a* and 11*b* of the arcuate bank 11 past the one-way stopper 12. It is to be noted that the direction in which the circumferentially urging force exerted by the coil spring 13 acts on the rotary disc 10 so as to rotate the latter counterclockwise about the shaft 5 as viewed in FIG. 3 conforms to the lowering direction of the shaft 5 as shown by A in FIGS. 2, 3(*a*) and 3(*d*).

The one-way stopper 12 provided on the rotary disc 10 is so shaped and so designed that, when the shaft 5 is rotated in the raising direction, the actuating pin 14 angularly moving together with the shaft 5 can smoothly slide over a sloped area 12*a* of the stopper 12 while pressing the rotary disc 10 against the axially biasing force of the coil spring 13 without allowing the disengagement of the pawl member 19 from the ratchet gear 10*a* of the rotary disc 10, but when the shaft 5 once rotated in the raising direction with the actuating pin 14 having moved past the stopper 12 is rotated in the lowering direction A, the actuating pin 12 being angularly moved can abut against the stopper 12 to provide a resistance to the continued turn of the shaft 5 in the lowering direction. However, the actuating pin 14 once brought into abutment with the stopper 12 can be forcibly jumped over the stopper 12 onto a flank area between the stopper 12 and the bent end 11*b* through the sloped area 12*a* of the stopper 12 when an external rotating force greater than that required to turn the shaft 5 so as to angularly move the actuating pin 14 in another flank area between the bent end 11*a* and the stopper 12 and sufficient to overcome the resistance provided by the stopper 12 is applied to the shaft 5 through the knob. This is possible because the actuating pin 14 has a circular cross-section and, on the other hand, because the stopper 12 protruding from the rotary disc 10 in a direction perpendicular of the actuating pin 14 terminates in a plane orthogonal to the shaft 5 and containing the longitudinal axis of the pin 5, or at a position spaced a slight distance from such plane inwardly of the rotary disc 10.

Figure 6:
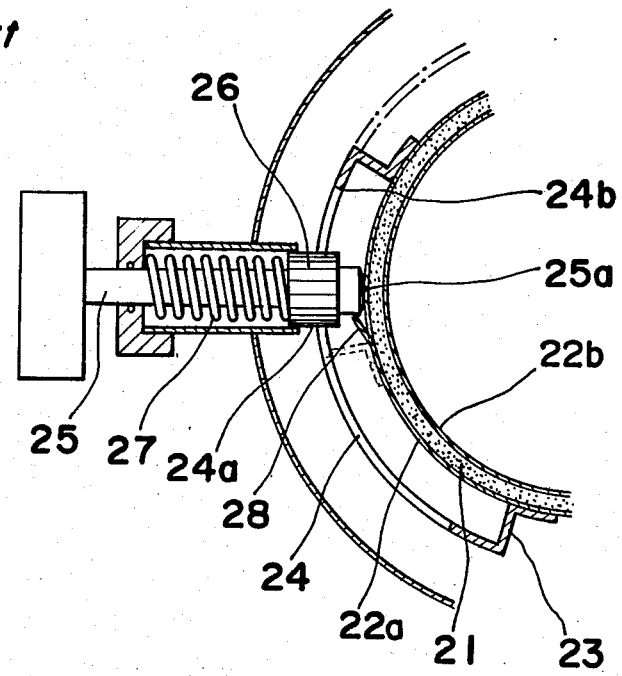
Fig. 6 Prior Art
FIG. 6 is a fragmentary transverse sectional view of the prior art oil heater.

So long as the rotary disc 10 is held in the operative position, the bent end 11*a* delimits the maximum combustion position, defined in connection with the prior art oil heater with reference to FIGS. 6 and 7 and shown by I in FIG. 1; that end of the stopper 12 which the actuating pin 14 abuts against during the turn of the shaft 5 in the lowering direction A delimits the minimum combustion position also defined in connection with the prior art oil heater and shown by II in FIG. 1; and the bent end 11*b* dilimits a first extinguishing position, shown by IV in FIG. 1, at which the burner flame can be extinguished completely in a predetermined time, for example, about 300 seconds or less, after the top end of the wick 3 has been retracted inwardly of the annular space to such first extinguishing position III. The determination of about 300 seconds for the predetermined time within which the burner flame can be completely extinguished when the wick 3 has been moved down to the first extinguishing position is not critical, but any length of time may be chosen for such predetermined time depending on a particular design of the oil heater and in condideration of the necessity of elimination or minimization of smoldering.

So far shown, the wick 3 in the oil heater according to the present invention can further be moved to a final or quick extinguishing position, shown by IV in FIG. 1 and positioned on one side of the first extinguishing position III opposite to the combustion positions I and II, in the event that the oil heater normally assuming an upright position is excessively or unreasonably deviated out of the upright position, for example, upon tilting thereof.

If the oil heater is in use with the flame produced from the top end of the wick 3, and in the event of the occurrence of an earthquake of a magnitude enough to cause the oil heater to tilt or in the event of the tilting or overturn of the oil heater by or for any reason. The wick 3 can quickly move to the final extinguishing position past the first extinguishing position to allow the burner flame to extinguish substantially instantaneously. In order to achieve this, the rotary disc 10 has to be rotatable from the operative position shown in any one of FIGS. 3(*a*) to 3(*c*) to a disabled position shown in FIG. 3(*d*) in the direction conforming to the lowering direction A by the action of the circumferentially urging force accumulated in the coil spring 13.

For enabling the rotary disc 10 in the operative position to be driven to the disabled position to eventually bring the wick 3 to the final extinguishing position quickly, the pawl member 19 is operatively associated with, and forms a part of, an attitude sensor 16 which may be termed as an emergency extinguisher. The attitude sensor 16 comprises as, shown in FIG. 1, a weighted balancer 17 capable of displacing out of its normal position when the oil heater is tilted or overturned in any direction, and an operating lever 18 normally urged to and held in a locking position but movable to an unlocking or release position in response to the displacement of the blancer 17 out of the normal position. The pawl member 19 may be either an integral part of, or rigidly secured to, the operating lever 18 so that only when the operating lever 18 is moved to the unlocking position, the pawl member 19 can disengage from the ratchet gear 10*a* of the rotary disc 10 to allow the latter to quickly turn from the operative position towards the disabled position by the action of the coil spring, but when and so long as the operating lever 18 is in the locking position under the influence of a biasing force overcoming the circumferentially urging force of the coil spring 13, the pawl member 19 can be held in engagement with the ratchet gear 10*a* to restrain the rotary disc 10 to rotate in the direction conforming to the lowering direction A.

The oil heater of the construction described with reference to and shown in FIGS. 1 to 3 can be operated in the following manner.

Assuming that the attitude sensor 16 is inoperative with the pawl member 19 consequently held in engagement with one of the ratchet teeth 10*a* on the rotary disc 10, and assuming that the rotary disc 10 is held at the disabled position, the wick 3 is held at the final extinguishing position IV. This condition is presumed as occupied by the oil heater at the time of shipment and before the user starts using it subsequent to the purchase thereof. Starting from this condition, and when the wick adjusting shaft 5 is turned in the raising direction (clockwise as viewed in FIG. 3) by the application of an external rotating force to the knobs 15, the rotary disc 10 is rotated in a direction conforming to the raising direction with the actuating pin 14 engaged with and pressing the bent end 11*a* fast with the rotary disc 10. At this time, the pawl member 19 allows the ratchet teeth 10*a* to move therebelow and, on the other hand, the rotation of the rotary disc 10 is accompanied by the twisting of the coil spring 13 to allow the latter to increase the circumferentially urging force accumulated therein. The turn of the shaft 5 in the raising direction is continued until the rotary disc 10 reaches the operative position shown in FIGS. 3(*a*) to 3(*c*).

Simultaneously with the arrival of the rotary disc 10 at the operative position from the disabled position, the wick 3 is brought to the maximum combustion position I by the action of the rack-and-pinion mechanism in a manner well known to those skilled in the art. Subsequent release of the external rotating force applied to the knob 15 for turning the shaft 5 in the raising direction does not result in the return rotation of the rotary disc 10 because the pawl member 19 is engaged with another one of the ratchet teeth preventing the disc 10 from being rotated by the accumulated urging force of the coil spring 13 as shown in FIG. 3(*a*).

With the wick 3 so brought to the maximum combustion position I, the user can ignite the fuel soaked in the wick 3 to make the burner produce a flame, the heat output of which is maximum. However, where the user wish to reduce the heat output of the burner, the wick adjusting shaft 5 is to be turned in the lowering direction A.

As the shaft 5 is turned in the lowering direction A, not only is the wick 3 lowered by the action of the rack-and-pinion mechanism down from the maximum combustion position I, but the actuating pin 14 fast with the shaft 5, which has been engaged to the bent end 11*a* fast with the rotary disc 10 disengages from the bent end 11*a*. The wick 3 can reach the minimum combustion position when the shaft 5 is turned in the lowering direction A until the actuating pin 14 abuts against the one-way stopper 12 as shown in FIG. 3(*b*). Thus, the size of the burner flame and, hence, the heat output, can be adjusted within a range bound by the flank area between the bent end 11*a* and the stopper 12 and in which the actuating pin 14 moves angularly while the rotary disc 10 is held in the operative position. Any possible excessive lowering of the wick 3 below the minimum combustion position II is advantageously avoided accordingly.

The further lowering of the wick 3 from or past the minimum combustion position II towards the first extinguishing position III can be accomplished by turning the shaft 5 in the lowering direction A by the application of a rotating force which must be greater than that required at the time of the lowering and raising of the wick 3 between the maximum and minimum combustion positions I and II and which is of a value sufficient to permit the actuating pin 14 to jump over the stopper 12 onto the sloped area 12*a* while urging the rotary disc 10 against the axially biasing force of the coil spring 13, it being, however, to be noted that the application of such greater rotating force to the knob 15 is required only when the actuating pin 14 is caused to jump over the stopper 12 while urging the rotary disc 10 against the coil spring 13. The condition assumed by the actuating pin 14 relative to the rotary disc 10 when the wick 3 has been moved to the first extinguishing position III is shown in FIG. 3(*c*), in which the pin 14 is restrained by the bent end 11*b* on one side of the stopper 12 opposite to the bent end 11*a* about the shaft 5.

Starting from the condition shown in FIG. 3(*c*), and the fuel soaked in the wick 3 is deisred to be ignited again, the shaft 5 has to be turned in the raising direction to allow the actuating pin 14 to move angularly towards the bent end 11*a* past the one-way stopper 12. Specifically during the angular movement of the actuating pin 14 towards the bent end 11*a*, the actuating member 14 slides over the sloped area axially against the coil spring 13 and subsequently falls from the stopper 12 down onto the flank area between the bent end 11*a* and the stopper 12 while allowing the rotary disc 10, which has been urged axially of the shaft 5 against the coil spring 13, to be moved axially by the action of the coil spring 13.

On the other hand, when the attitude sensor 16 is activated, for example, upon tilting of the oil heater, the operating lever 18 is instantaneously moved to the unlocking position in response to the deviation of the weighted balancer 17 out of the normal position with the pawl member 19 consequently disengaged from the ratchet tooth 10*a* on the rotary disc 10, allowing the latter to rotate from the operative position back to the disabled position under the influence of the circumferentially urging force of the coil spring 13 as shown in FIG. 3(*d*). The rotation of the rotary disc 10 so effected in the manner described above is accompanied by the angular movement of the actuating pin 14 and, hence, the rotation of the shaft 5 in the lowering direction A, because of the bent end 11*a* engaging and pressing the actuating pin 14, and consequently, the wick 3 is instantaneously moved to the final extinguishing position IV. Where the wick 3 is positioned at any one of, or within the range between, the maximum and minimum combustion positions I and II and is, therefore, producing the burner flame, the burner flame can substantially instantaneously be extinguished upon the arrival of the wick 3 at the final extinguishing position because, with the wick 3 positioned thereat, the top end of the wick 3 is retracted into the annular space between the tubes 2*a* and 4 more deeper than that when the wick 3 is lowered to the first extinguishing position III.

Figure 4:
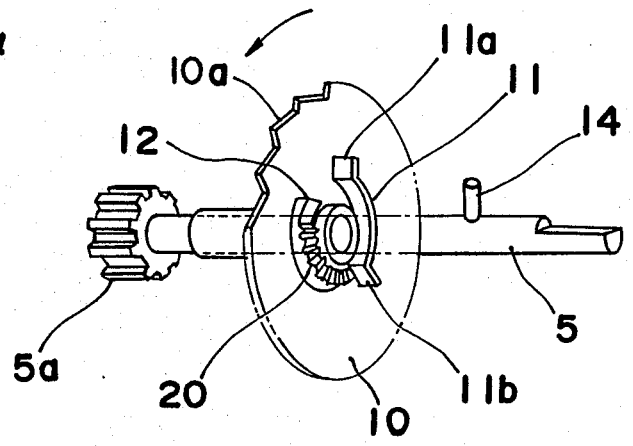
FIG. 4 is a view similar to FIG. 2, showing another embodiment of the present invention.
Figure 5:
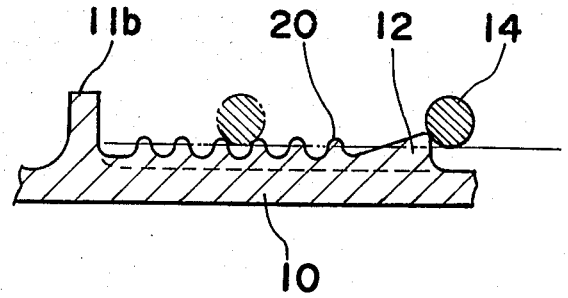
FIG. 5 is a fragmentary sectional view of a portion of the rotary disc shown in FIG. 4.

In the embodiment shown in FIGS. 4 and 5, the sloped area of the one-way stopper 12, which is shown in FIG. 2 as downwardly sloped so as to terminate a distance spaced from the bent end 11*b*, is downwardly sloped so as to terminate at the root of the bent end 11*b* as best shown in FIG. 5 and is formed with a seris of indentations 20. These indentations 12 on the sloped area of the one-way stopper 12 are operable to appeal to the sense of touch of the user, as the actuating pin 14 moves along the indented sloped area of the stopper 12, thereby to make the user aware of the wick 3 being lowered towards or raised from the first extinguishing position III. In other words, the presence of the indentations 20 differentiates the touch of rotation of the shaft 5 with the actuating pin 14 moving along the sloped area of the stopper 12 from the touch of rotation of the shaft 5 with the actuating pin 14 moving in the flank area between the stopper 12 and the bent end 11*a*.

Although the present invention has been fully described by way of the preferred embodiments thereof with reference to the accompanying drawings, it is to be noted that various changes and modifications are apparent to those skilled in the art. By way of example, the attitude sensor may be provided with a manipulatable release mechanism or lever for manually releasing the operating lever 18 from the locking position regardless of whether or not the oil heater is tilted or overturned. The provision of the manual release mechanism or lever would give rise to an effect in the event of the occurence of abnormal combustion accompanied by abrupt rise of burner flame.

Moroever, the indentations 20 shown and described as formed on the sloped area of the one-way stopper may be formed on a portion of the rotary disc 10 between the stopper 12 and the bent end 11*a* in which case calibrated adjustment of the wick will be possible.

In addition, although not shown, at least one perforated combustion shell is in practice mounted on the top of the burner to be red-heated for facilitating radiation of heat. This design is well known to those skilled in the art.

Accordingly, such changes and modifications are to be understood as included within the true scope of the present invention as defined by the appended claims, unless they depart therefrom.

What is claimed is:

1. An oil heater having a wick fed radiant burner which comprises a shaft means rotatable in first and second directions one at a time for raising and lowering a wick between a combustion position and an extinguished position, a spring means capable of accumulating a biasing force necessary to lower the wick, held at the combustion position, to the extinguished position pursuant to the manipulation of the shaft means, a rotatable body rotatably mounted on the shaft means and having its periphery provided with a pluality of teeth, a locking element engageable with any one of the teeth of the rotatable body under pressure for preventing the rotatable body from rotating in the same direction as the second direction of rotation of the shaft means, an attitude sensor for releasing the locking element from the engagement with said one of the teeth of the rotatable body upon tilting of the oil heater, an actuating member provided on the shaft means and pressed by the rotatable body, and a one-way stopper provided on that portion of the rotatable body which is located on the path of angular movement of the actuating member and operable to interrupt the rotation of the shaft means in the second direction at a predetermined position, said rotatable body being so supported by said biasing spring that, by the application of an external rotating force greater than that required to rotate the shaft means in the second direction, the rotatable body can be displaced axially of the shaft means to permit the rotation of the rotatable body.

2. An oil heater as claimed in claim 1, further comprising an arcuate engagement bank provided on the rotatable body in alignment with the path of movement of the actuating member so as to extend in a direction conforming to the direction of movement of the actuating member, whereby the height of the wick lowered by the rotation of the shaft means is stopped at a position preceding the lowest height position to which the wick can be quickly lowered by the action of the spring means upon the release of the locking element from said one of the teeth of the rotatable body.

3. An oil heater as claimed in claim 1, wherein indentations are formed on the rotatable body on one of the opposite sides of the stopper in alignment with the path of movement of the actuating member for appealing to the sense of touch.

4. An oil heater as claimed in claim 1, wherein the spring means concurrently serves to press the rotatable body to contact the actuating member.

5. An oil heater heaving a wick fed radiant burner which comprises a shaft means rotatable in first and second directions one at a time for raising and lowering a wick between a combustion position and an extinguished position, a spring means capable of accumulating a biasing force necessary to lower the wick, held at the combustion position, to the extinguished position pursuant to the manipulation of the shaft means, a rotatable body rotatably mounted on the shaft means and having its periphery provided with a plurality of teeth, a locking element engageable with any one of the teeth of the rotatable body under pressure for preventing the rotatable body from rotating in the same direction as the second direction of rotation of the shaft means, an attitude sensor for releasing the locking element from the engagement with said one of the teeth of the rotatable body upon tilting of the oil heater, an actuating member provided on the shaft means and pressed by the rotatable body, a one-way stopper provided on that portion of the rotatable body which is located on the path of angular movement of the actuating member and operable to interrupt the rotation of the shaft means in the second direction at a predetermined position, said rotatable body being so supported by said biasing spring that, by the application of an external rotating force greater than that required to rotate the shaft means in the second direction, the rotatable body can be displaced axially of the shaft means to permit the rotation of the rotatable body, and an arcuate engagement bank provided on the rotatable body in alignment with the path of movement of the actuating member so as to extend in a direction conforming to the direction of movement of the actuating member, whereby the height of the wick lowered by the rotation of the shaft means is stopped at a position preceding the lowest height position to which the wick can be quickly lowered by the action of the spring means upon the release of the locking element from said one of the teeth of the rotatable body.

6. An oil heater as claimed in claim 5, wherein indentations are formed on the rotatable body on one of the opposite sides of the stopper in alignment with the path of movement of the actuating member for appealing to the sense of touch.

7. An oil heater as claimed in claim 5, wherein the spring means concurrently serves to press the rotatable body to contact the actuating member.

8. An oil heater having a wick fed radiant burner which comprises a wick adjusting shaft supported for rotation in first and second directions opposite to each other one at a time about the longitudinal axis thereof; a wick holder adapted to hold a wick for movement together therewith, said wick being movable between an extinguishing position and a maximum combustion position past a minimum combustion position generally intermediate between the maximum and extinguishing positions; means for transmitting a rotary motion of the shaft to the wick holder for lowering and raising the wick holder in response to the rotation of the shaft in the first and second directions, respectively, said wick being moved towards the extinguishing position and the maximum combustion position as the wick holder is lowered and raised, respectively; a plate-like member mounted on the shaft for displacement axially of the shaft; an actuating member mounted on the shaft so as to extend perpendicularly of the shaft and angularly movable together with the shaft; an abutment means provided on the plate-like member for defining the angular distance over which the actuating member moves as a result of the rotation of the shaft, said angular distance corresponding to the distance of movement of the wick holder between the maximum combustion position and the extinguishing position; a biasing spring for urging the plate-like member towards the actuating member; and a one-way stopper provided on the plate-like member in alignment with the path of movement of the actuating member and operable to permit the actuating member to pass thereover during the rotation of the shaft in the second direction, but to restrain the actuating member from passing thereover during the rotation of the shaft in the first direction thereby providing the minimum combustion position to the movement of the wick holder, said actuating member once restrained being released from the one-way stopper when the shaft is rotated in the first direction by the application of an external rotary force sufficient to cause the actuating member to displace the plate-like member against the biasing spring while permitting the actuating member to pass over the one-way stopper.

9. An oil heater as claimed in claim 8, wherein said plate-like member is a ratchet wheel and also rotatable between operative and disabled positions about the shaft independently of said shaft, and wherein said biasing spring also exerting a circumferentially acting force necessary to turn the ratchet wheel in one direction conforming to said first direction towards the disabled position, and further comprising a releaseable latch means for releaseably holding the ratchet wheel at the operative position, said wick holder being, when and so long as the ratchet wheel is held at the disabled position, held at a quick extinguishing position located on one side of the extinguishing position opposite to the minimum combustion position, said actuating member being movable over said angular distance independently of the ratchet wheel when and so long as the ratchet wheel is held in the operative position, said ratchet wheel being, when released from the operative position, quickly rotated from the operative position to the disabled position by the circumferentially acting force of the spring, the quick rotation of the ratchet wheel being accompanied by the engagement of the abutment means with the actuating member to move the latter in the direction conforming to said first direction thereby to bring the wick holder to the quick extinguishing position.

* * * * *